US008258901B2

(12) United States Patent
Hao

(10) Patent No.: US 8,258,901 B2
(45) Date of Patent: Sep. 4, 2012

(54) ENERGY-SAVING ELECTROMAGNETIC SWITCH DEVICE

(76) Inventor: Chungtai Hao, Taipei (CN)

( * ) Notice: Subject to any disclaimer, the term of this patent is extended or adjusted under 35 U.S.C. 154(b) by 0 days.

(21) Appl. No.: 13/377,153

(22) PCT Filed: Jun. 1, 2010

(86) PCT No.: PCT/CN2010/073417

§ 371 (c)(1), (2), (4) Date: Dec. 9, 2011

(87) PCT Pub. No.: WO2010/142212

PCT Pub. Date: Dec. 16, 2010

(65) Prior Publication Data

US 2012/0081199 A1 Apr. 5, 2012

(30) Foreign Application Priority Data

Jun. 11, 2009 (CN) ..... 2009 1 0303165

(51) Int. Cl.

| | |
|---|---|
| ***H01H 51/08*** | (2006.01) |
| ***H01H 51/22*** | (2006.01) |
| ***H01H 9/20*** | (2006.01) |

(52) U.S. Cl. ..... 335/167; 335/78; 335/79; 335/80; 335/86; 335/132; 335/138; 335/168

(58) Field of Classification Search ..... 335/78–86, 335/157, 158, 167–171, 179, 132, 138
See application file for complete search history.

(56) References Cited

U.S. PATENT DOCUMENTS 3,153,178 A * 10/1964 Martin ..... 335/234

* cited by examiner

*Primary Examiner* — Ramon Barrera

(57) ABSTRACT

An energy-saving electromagnetic switching device in the present invention includes a housing, and an electromagnetic assembly and a movable magnetic pole within the housing. The movable magnetic pole connects a resilience means which engages with the movable magnetic pole to control the electromagnetic switching device switched on and off. At least one locking assembly is set between the movable magnetic pole and the housing, via which the electromagnetic switching device can automatically and repeatably change from an on-state to an off-state if the electromagnetic assembly is momentarily energized. The electromagnetic switching device is energy-saved, has higher automatization degree, simple operation, and lower cost.

4 Claims, 10 Drawing Sheets

ENERGY-SAVING ELECTROMAGNETIC SWITCH DEVICE

BACKGROUND OF THE INVENTION

The present invention relates to an energy-saving electromagnetic switching device.

A general electromagnetic switching device usually comprises an electric relay or a contactor, which usually comprises an electromagnetic unit and a movable magnetic pole. When the electromagnetic switching device is desired to be closed, it shall be energized to produce electromagnetic force. Under the electromagnetic force, the movable magnetic pole moves downwardly to make the switching device closed. To keep the switching device in working mode, the switching device shall be kept energized continuously so that the electromagnetic force draws the movable pole to make engagement; to make the switching device disengaged, the switching device shall be de-energized so that the electromagnetic force disappears, the movable magnetic pole is restored to the original position, and thus the switching device become open. From aforementioned structure and working principle of the general electromagnetic switching device, a working electromagnetic switching device shall be continuously energized to produce electromagnetic force. Therefore, to keep switching device working, it wastes much electrical energy.

To overcome the structure disadvantage of the prior switching device, early at beginning of the 1990s, some kinds of energy-saving electromagnetic switching devices was studied. However, the early energy-saving electromagnetic switching devices usually have complicate structure and high cost of production, and seldom been merchandized on the market. Therefore, it is desired to supply an energy-saving electromagnetic switching device with much simpler structure and lower-cost than the prior switching device.

BRIEF SUMMARY OF THE INVENTION

A technical question to be resolved of the present invention is to provide an energy-saving electromagnetic switching device, which needs not to be continuously energized to keep in working mode, and has much simpler structure.

To obtain the above object, an energy-saving electromagnetic switching device in the present invention comprises: a housing, and an electromagnetic assembly and a movable magnetic pole within the housing. The movable magnetic pole connects a resilience means which engages with the movable magnetic pole to control the electromagnetic switching device switched on and off. At least one locking assembly is set between the movable magnetic pole and the housing, via which the electromagnetic switching device can automatically and repeatably change from an on-state to an off-state if the electromagnetic assembly is momentarily energized.

According to the design idea of the present invention, the locking assembly comprises a locking block, a locking clip and a flexible member. The locking block defines a stepwise center groove at a side face towards the locking clip. An outside face of the locking clip abuts against the flexible member, and under the flexible member preventing, one end of the locking clip is received in the center groove. A stopping portion projects generally at center of the groove. The center groove comprises a guiding groove section, limiting groove section, unlocking groove section, and returning groove section, which are successively associated together and surround the stopping portion. A leading slope is bridged from bottom portion to tip portion of the guiding groove section in a gradually ascending way. The bottom portion of the guiding groove section has greater depth than that of bottom portion of the returning groove section; the limiting groove section has greater depth than that of tip portion of leading slope of the guiding groove section; the unlocking groove section has greater depth than that of the limiting groove section, a tip portion of the returning groove section has greater depth than that of the unlocking groove section. When the electromagnetic switching device is desired to switch on, the locking clip slides from the bottom of the guiding groove section along the leading slope to the limiting groove section, when the electromagnetic switching device is de-energized, the locking clip slides to the unlocking groove section and is caught in the stopping portion under a resilience force of the resilience means. When the electromagnetic switching device is desired to change from on-state to off-state, the locking clip leaves the stopping portion and slides from the unlocking groove section to the tip portion of the returning groove section, when the electromagnetic switching device is de-energized, the locking clip slides from the tip portion along a bottom portion of the returning groove section and to the bottom portion of the guiding groove section under a resilience force of the resilience means.

According to the design idea of the present invention, the energy-saving electromagnetic switching device is an electric relay. The electromagnetic assembly of the electric relay comprises an iron core and a coil winding around the iron core. The movable magnetic pole of the electric relay comprises a metal body and a contact carrying arm, and the metal body is located below the contact carrying arm. One end of the contact carrying arm is mounted on an upper surface of the metal body, and the other end of the arm carries a movable contact. A stationary contact is correspondingly set on the metal body. The resilience means is preferably a spring, one end of the spring is connected at a bottom of the housing of the electric relay, and the other end thereof is connected to an end of the metal body corresponding to where the contact carrying arm is mounted. There is one locking assembly in the electric relay. The locking block of the locking assembly thereof receives an end of the metal body, and the locking clip and the flexible member are mounted to the housing.

According to the design idea of the present invention, the energy-saving electromagnetic switching device is a contactor. The electromagnetic assembly of the contactor comprises an E-shaped stationary iron core and a coil connected with the stationary iron core in the housing. The movable magnetic pole of the contactor comprises movable iron core and contact which is substantially connected with the movable iron core. The movable iron core corresponds to the stationary iron core, and is located right above the stationary iron core. The resilience means is preferably a spring set around a center part of the stationary core. There are two locking assemblies in the contactor, which are respectively and centrally located at either side of the housing of the contactor. The locking block of the locking assembly is fixed at side face of the movable iron core. One end of the locking clip is received in the center groove of the locking block, and the other end thereof is rotatably mounted in the housing of the contactor.

Being compared to the prior art, the electromagnetic switching device of the present invention has such advantages as: (1) via the locking assembly, the movable magnetic pole can keep the electromagnetic switching device in an on-state once the coil of the electromagnetic assembly is energized not continuously but momentarily, thus it is energy-saved; (2) since the locking assembly comprises locking block, locking clip, and flexible member, which results in a simple structure and lower cost of production; (3) via the locking assembly of the present invention, the electromagnetic switching device switches on once being momentarily energized; and switches from on to off once being momentarily energized again, the locking assembly can set the electromagnetic switching device to restore an off-state, therefore, it has higher automatization degree, and simple operation.

DETAILED DESCRIPTION OF THE INVENTION

An energy-saving electromagnetic switching device of the present invention comprises a housing, an electromagnetic assembly, and movable magnetic pole. The magnetic pole connects with a resilience means. Herein, the electromagnetic assembly and movable magnetic pole are positioned in the housing. The electromagnetic assembly is used for producing electromagnetic force. Under the electromagnetic force, the movable magnetic pole with engagement of the resilience means sets the electromagnetic switching device to switch on. For saving energy, the electromagnetic switching device is de-energized and can still keep in a closed state. The electromagnetic switching device of the present invention have at least one locking assembly set between the movable magnetic pole and the housing, via which the electromagnetic switching device automatically changes from on-state to off-state as it is momentarily energized. The locking assembly of the present invention is to be described in detail according to the drawings, and an electric relay and a contactor are respectively as examples to illustrate the electromagnetic switching device of the present invention.

Figure 3:
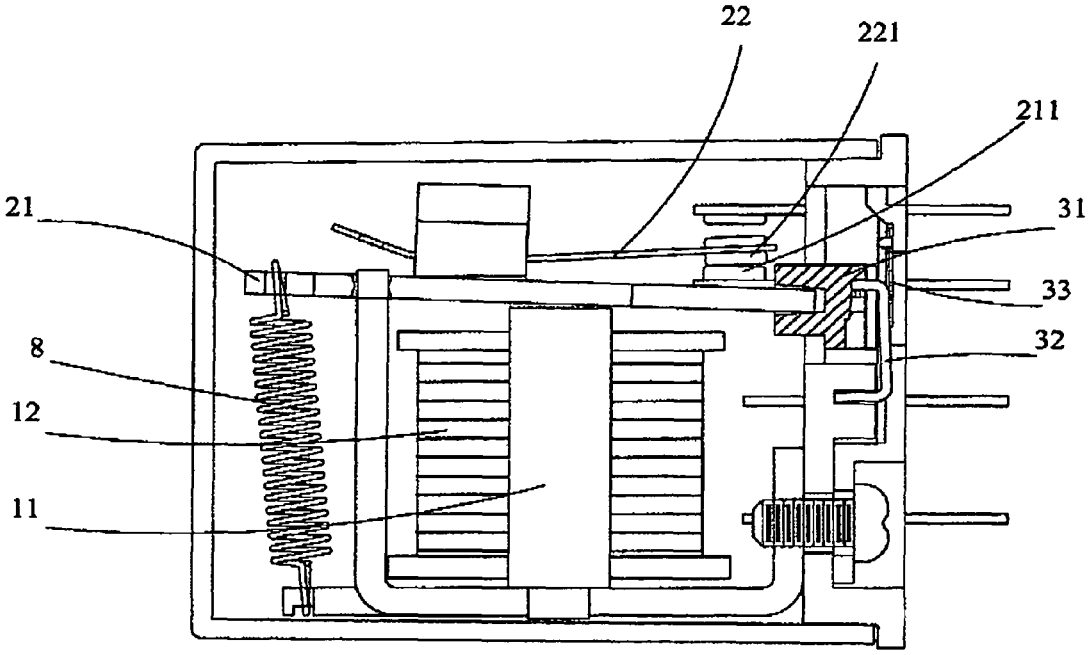
FIG. 3 is a front and sectional view of the energy-saving electromagnetic switching device in accordance with a first embodiment of the present invention.
Figure 4:
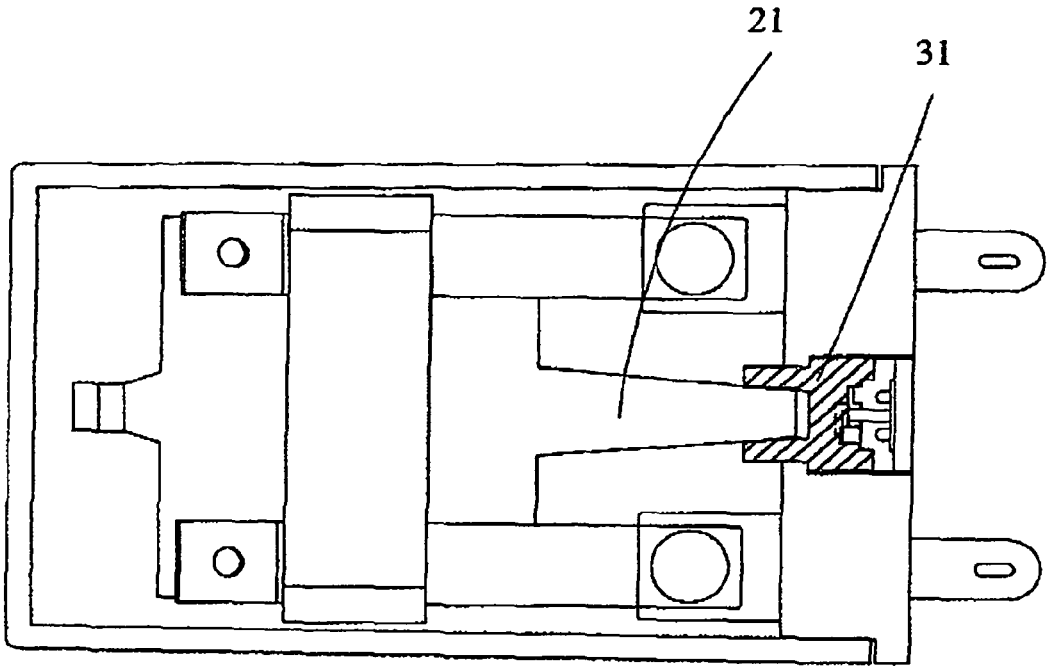
FIG. 4 is a top and sectional view of the electromagnetic switching device in accordance with the first embodiment of the present invention.

Referring to FIGS. 3-4 together, the electromagnetic switching device in accordance with the first embodiment, is an electric relay. The electromagnetic assembly of the electric relay comprises an iron core 11 and a coil 12. The coil 12 winds around the iron core 11 for coupling with the iron core 11 so that the iron core 11 may produce magnetism. The movable magnetic pole of the electric relay comprises a metal body 21 and a contact carrying arm 22. The metal body 21 is located below the contact carrying arm 22. One end of the contact carrying arm 22 is mounted on the upper surface of the metal body 21, and the other end of the arm 22 carries a movable contact 221. A pair of stationary contacts 211 is respectively disposed on the metal body 21 and the housing at corresponding positions. The pair of stationary contacts 211 is respectively set for a normally-open state and a normally-closed state. The resilience means is preferably a spring 8 in this embodiment. One end of the spring 8 is connected at a bottom of the housing of the electric relay, and the other end thereof is connected to the end of the metal body 21 corresponding to where the contact carrying arm 22 is mounted.

In a working mode, the coil 12 urges the iron core 11 to produce magnetic force. Under the magnetic force, the metal body 21 drives arm 22 and a locking block 31 moving downwardly together so that the movable contact 221 is engaged with the stationary contact 211 for a closed state. Then, the electromagnetic switching device keeps in a closed state.

The electric relay of the present invention preferably sets only one locking assembly, which is arranged between the metal body 21 and the housing. The metal body 21 is inserted in the locking block 31 of the locking assembly, referring to FIG. 3 again. The locking assembly comprises the locking block 31, a locking clip 32 and a flexible member 33. The locking clip 32 with a U-shaped cross section has one end thereof received in a groove of the locking block 31, and the other end rotatably mounted to the housing and able to swing. The flexible member 33 is positioned outside of and abuts against the locking clip 32 so that the locking clip 32 slides in the groove of the locking block 31.

Figure 1A:
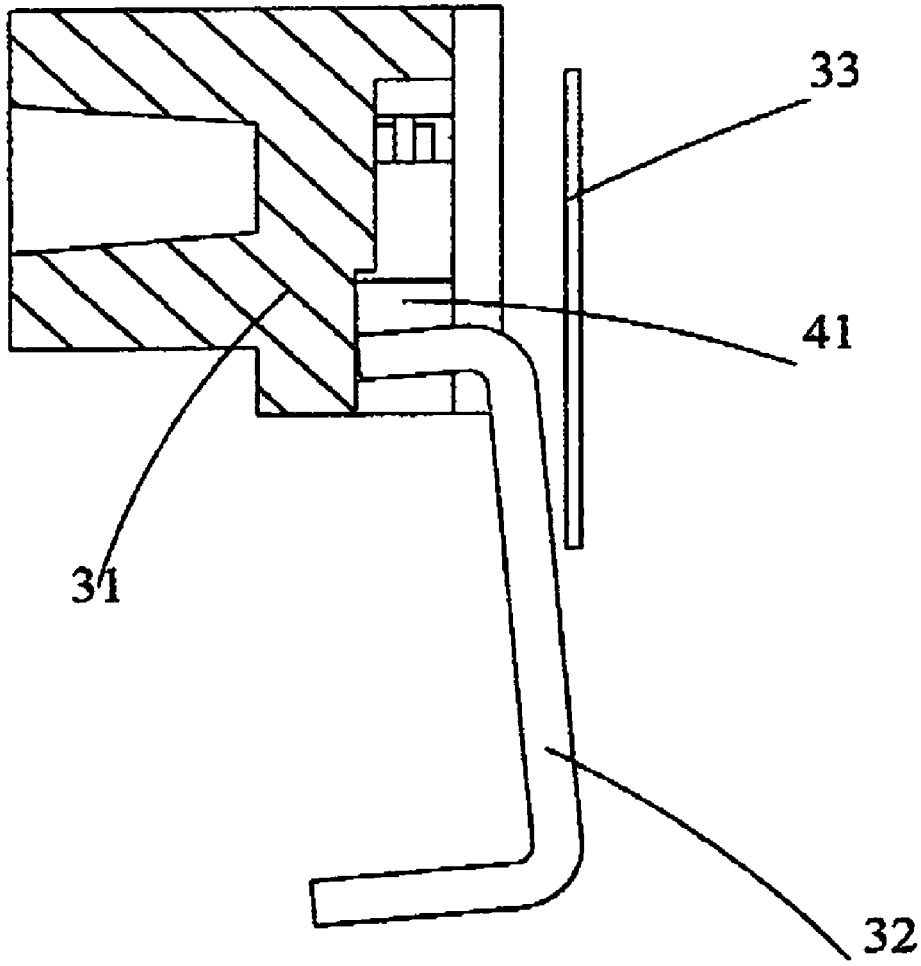
FIG. 1*a* is a sectional view of a locking assembly of the present invention, which shows a relative position of each part of the locking assembly as an electromagnetic switching device in an open state.
Figure 1B:
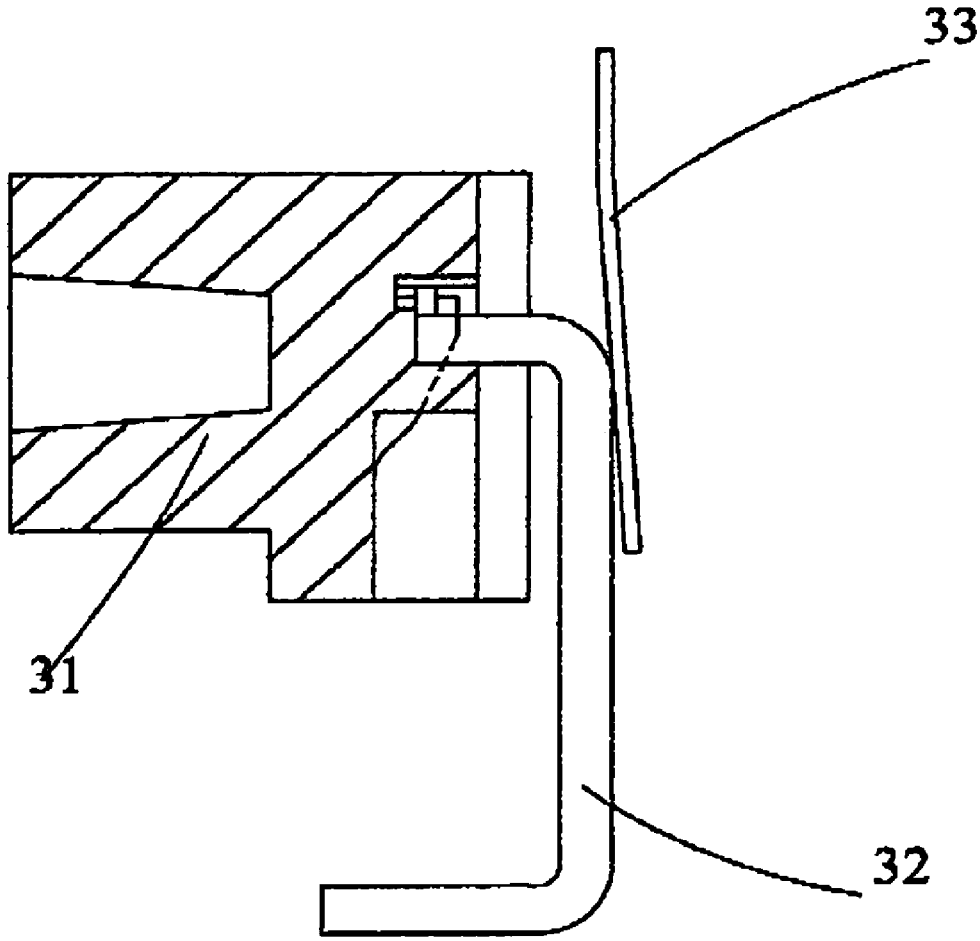
FIG. 1*b* is a sectional view of the locking assembly of the present invention, which shows a relative position of each part of the locking assembly as the electromagnetic switching device in a closed state.

Referring to FIGS. 1*a*-1*b*, the locking block 31 defines the stepwise center groove 41 at the side face towards the locking clip 32. The outside face of the locking clip 32 abuts against the flexible member 33. Under the flexible member 33 preventing, one end of the locking clip 32 slides in the groove 41, the other end thereof is mounted to the housing of the electromagnetic switching device. A stopping portion 415 projects generally at center of the groove 41.

Figure 2A:
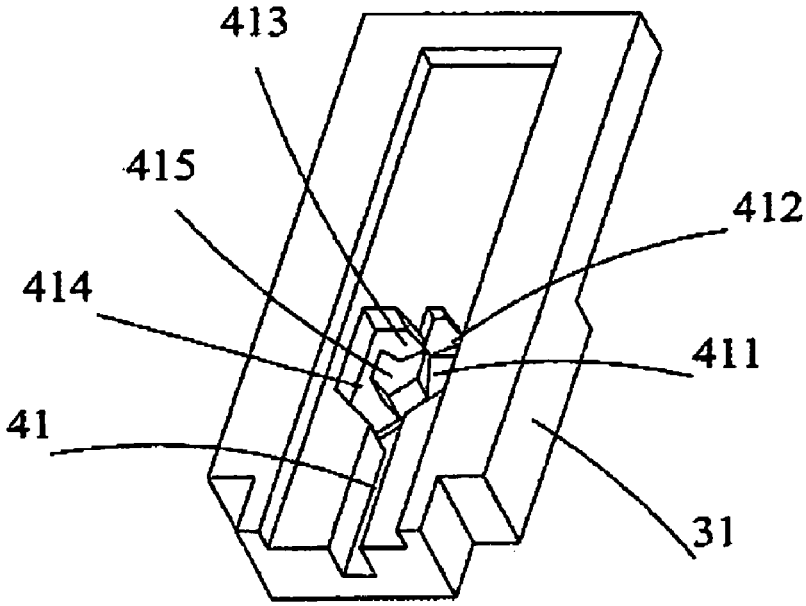
FIG. 2*a* is a perspective view of a locking block of the present invention.
Figure 2B:
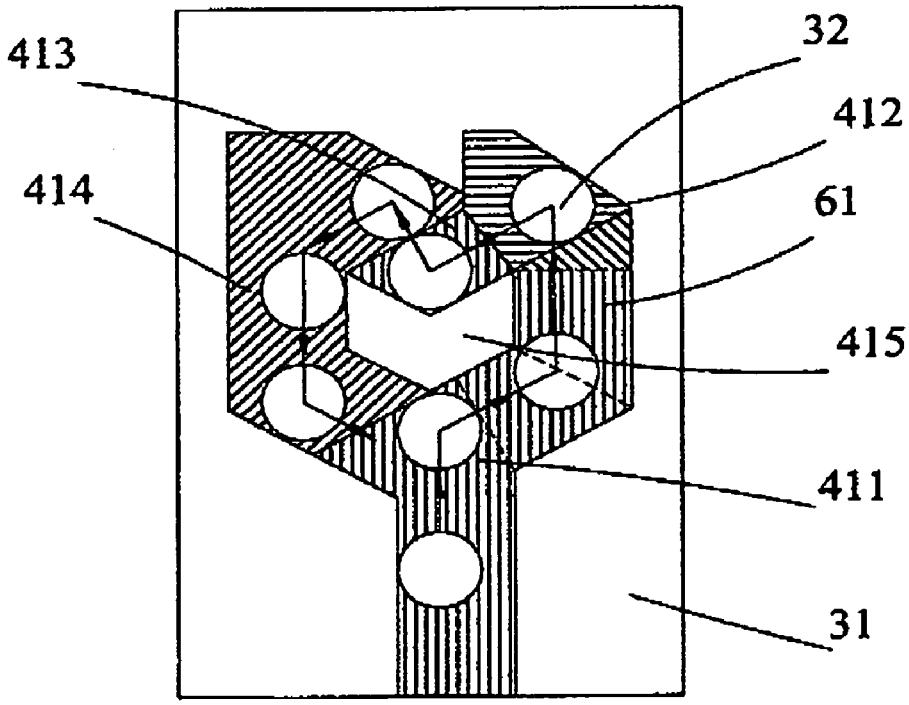
FIG. 2*b* is a front view of the locking block of the present invention, which shows a motion path of an locking clip when the electromagnetic switching device changes from the closed state to the open state.

Referring to FIG. 2*b*, the center groove 41 comprises a guiding groove section 411, limiting groove section 412, unlocking groove section 413, and returning groove section 414, which are successively associated together and surround the stopping portion 415. A leading slope 61 is bridged from bottom portion to tip portion of the guiding groove section 411 in such a gradually ascending way. Furthermore, the bottom portion of the guiding groove section 411 has greater depth than that of the bottom portion of the returning groove section 414. The limiting groove section 412 has greater depth than that of tip portion of the guiding groove section 411. The unlocking groove section 413 has greater depth than that of the limiting groove section 412. The tip and bottom portions of the returning groove section 414 have greater depth than that of the unlocking groove section 413.

Referring to FIGS. 1*a*-1*b* again, when the electromagnetic switching device is desired to switch on, the electromagnetic assembly is energized. Thus the locking clip 32 slides along the slope 61 from bottom portion to the tip portion of the guiding groove section 411, and then to the limiting groove section 412. Herein, the electromagnetic assembly is de-energized, under the resilience force of the spring 8, the locking clip 32 slides from the limiting groove section 412 to unlocking groove section 413 and is caught in the stopping portion 415 (as shown in FIG. 1*b*). When the electromagnetic switching device is desired to switch off, the electromagnetic assembly is re-energized. Herein, under the magnetic force momentarily produced from electromagnetic assembly, the locking clip 32 slides from the unlocking groove section 413 to the tip portion of the returning groove section 414. Then, the electromagnetic assembly is de-energized, under the resilience force of the spring 8, the locking clip 32 slides from the tip of the returning groove section 414 and along the bottom portion of the returning groove section 414, and finally slides to bottom portion of the guiding groove section 411 (as shown in FIG. 1*a*). Such cycle operation is repeatable in turn.

Figure 5:
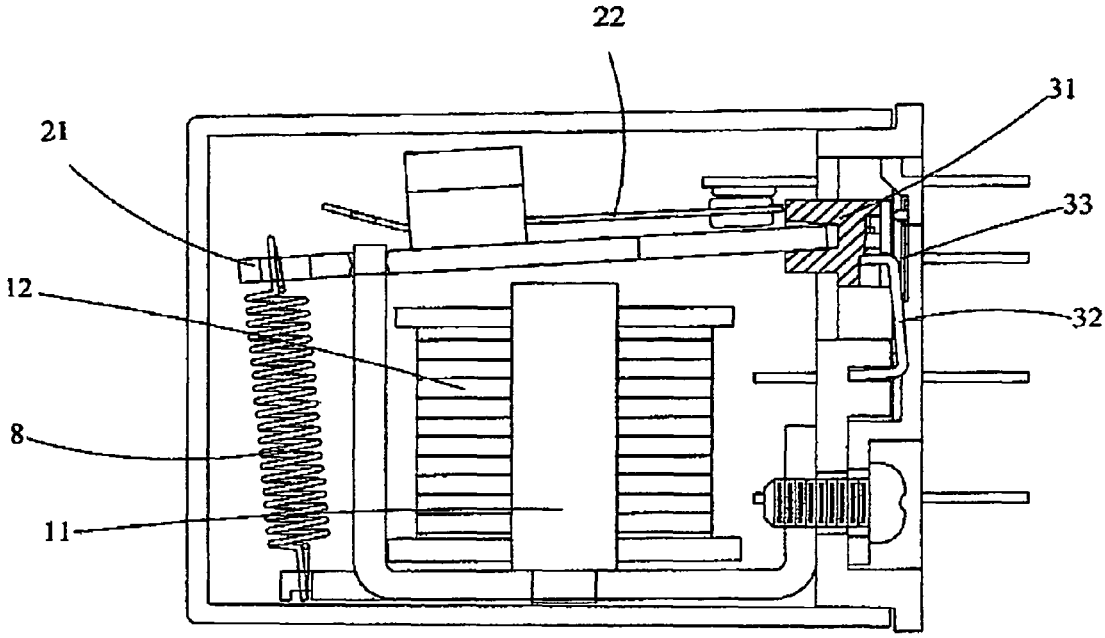
FIG. 5 is a sketch view of the electromagnetic switching device in the open state in accordance with the first embodiment of the present invention.

Referring to FIG. 5, which shows the electric relay in an open state. Herein, the electromagnetic assembly of the electric relay is de-energized. The movable contact 221 on the contact carrying arm 22 is engaged with the normally-closed stationary contact, and under the flexible member 33 preventing and the resilience force of the spring 8, the locking clip 32 is located at the bottom portion of the guiding groove section 411 (as shown in FIG. 1*a*).

Figure 6:
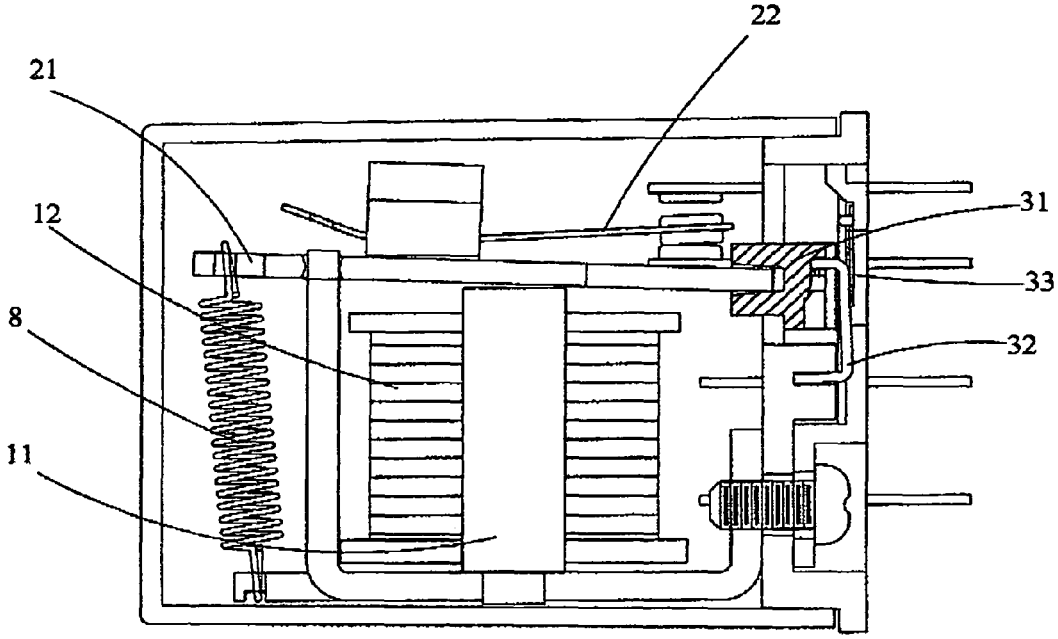
FIG. 6 is a sketch view of the electromagnetic switching device in the closed state in accordance with the first embodiment of the present invention.

Referring to FIG. 6, which shows the electric relay in a closed state. For changing from the open state in FIG. 5 to the closed state in FIG. 6, first, the electromagnetic assembly of the electric relay is necessary to be momentarily energized to produce magnetic force. Under the magnetic force, the metal body 21 drives the contact carrying arm 22 and the locking block 31 moving downwardly together such that the contact 221 gets engagement with the normally-open stationary contact 211 and becomes closed. During the downwards motion of the metal body 21 driving arm 22 and locking block 31, the locking clip 32 slides along the slope 61 from bottom portion to the tip portion of the guiding groove section 411, and then to the limiting groove section 412. Herein, the electromagnetic assembly is de-energized, under the resilience force of the spring 8 and the prevention of the flexible member 33, the locking clip 32 slides from the limiting groove section 412 to unlocking groove section 413 and is caught in the stopping portion 415 (as shown in FIG. 1*b*). Since the locking clip 32 is held by the stopping portion 415, the electric relay keep in the open state, and the electromagnetic assembly thereof is not necessary to be energized yet. The metal body 21 will not drive the contact carrying arm 22 to the normally-closed stationary contact. Therefore, the electric power is saved.

For changing from the closed state in FIG. 6 to the open state in FIG. 5, first, the electromagnetic assembly of the electric relay is necessary to be momentarily energized to produce magnetic force still. Under the magnetic force, the metal body 21 drives the contact carrying arm 22 and the locking block 31 moving downwardly together. The locking clip 32 leaves the stopping portion 415 at the unlocking groove section 413, slides to the tip portion of the returning groove section 414, and then under the prevention of the flexible member 33, slides into the tip portion of the returning groove section 414. When electromagnetic assembly is de-energized, under the resilience force of the spring 8, the locking clip 32 slides through the steps between the bottom portion of the returning groove section 414 to the guiding groove section 411, and finally slides to bottom portion of the guiding groove section 411. Therefore, a cycle operation is repeatable. The electromagnetic switching device has higher automatization degree, and operation to which is very simple. In FIG. 2*b* is labeled motion path of the locking clip 32 as the electromagnetic switching device changing from a closed state in FIG. 6 to an open state in FIG. 5. FIG. 2*a* shows the locking block of the locking assembly of the contactor in accordance with the second embodiment.

Figure 7:
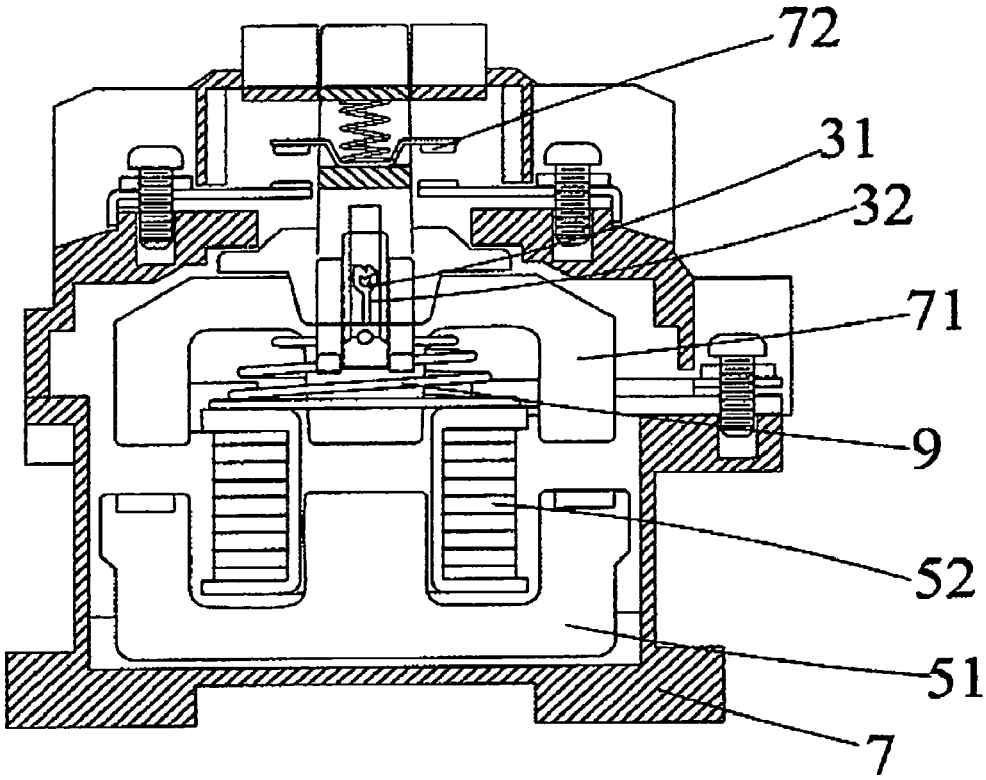
FIG. 7 is a front view of the electromagnetic switching device in accordance with a second embodiment of the present invention.
Figure 8:
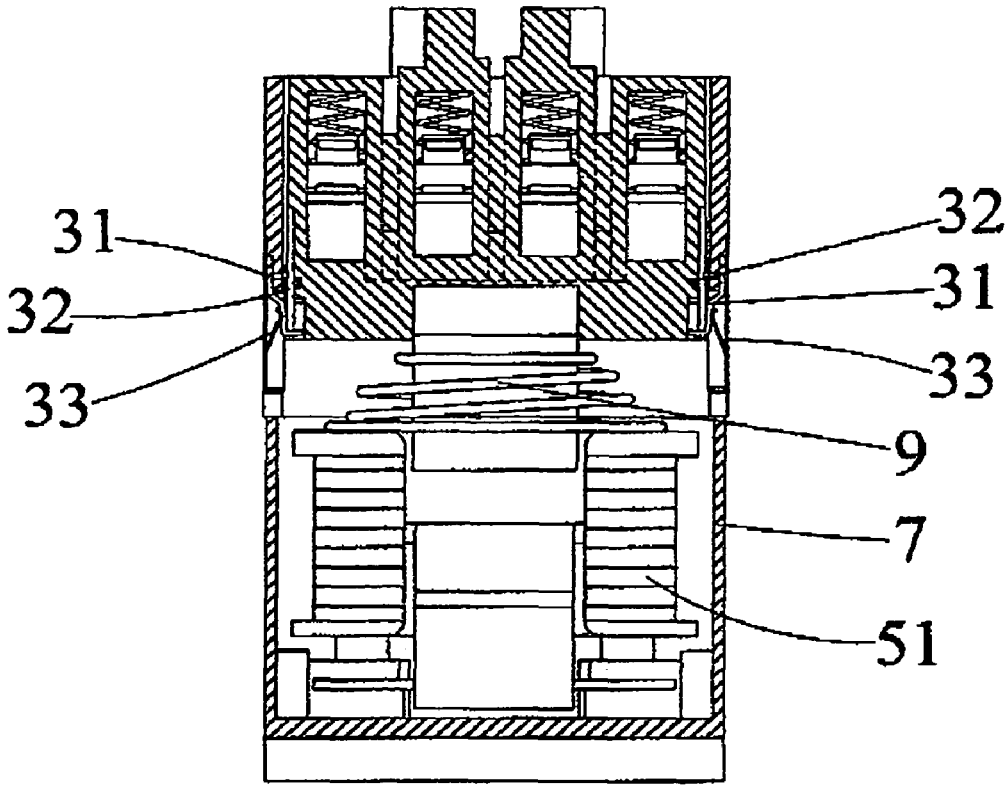
FIG. 8 is a side view of the electromagnetic switching device in accordance with the second embodiment of the present invention.

Referring to FIGS. 7-8, the electromagnetic switching device in accordance with the second embodiment, is a contactor. The contactor comprises a housing 7, electromagnetic assembly and movable pole, which are both positioned within the housing 7.

The electromagnetic assembly comprises a stationary iron core 51 and a coil 52. The stationary iron core 51 is E-shaped. The coil 52 is generally disposed in the central section of the stationary core 51 which is connected with the coil 52. The coil 52 is coupled to the stationary iron core 51 to produce magnetic force. The movable magnetic pole of the contactor comprises movable iron core 71 and contact 72 which is substantially connected with the movable iron core 71. The movable core 7 corresponds to the stationary core 51, and is located right above the stationary core 51. The resilience means is set around a center part of the stationary core 51. The resilience means is preferably a spring 9. The contactor has both sides respectively set one locking assembly at the center thereof. The locking assembly is the same as that of the electric relay in accordance with the first embodiment which is described in detail above. Therefore, the locking assembly is not to be described again.

The locking block 31 of the locking assembly is fixed at side face of the movable iron core 71. One end of the locking clip 32 abuts in the center groove 41 of the locking block 31, and the other end thereof is rotatably mounted in the housing 7 in the way of a swinging motion. The flexible member 33 is placed on the outside of the locking clip 32 for preventing the locking clip 32 so that the locking clip 32 slides in the center groove 41.

Since the contactor in accordance with the second embodiment has the locking assembly as well, to obtain a working mode of the contactor, the electromagnetic assembly is only momentarily energized thus the contactor switches on. Once the contactor switches on, then the electromagnetic assembly is de-energized, and the locking assembly can keep the contactor in the engaged mode, which results in power energy resource is saved. When work is finished, the electromagnetic assembly is momentarily energized again so that the locking assembly is restored, and the contactor switches off.

Figure 9A:
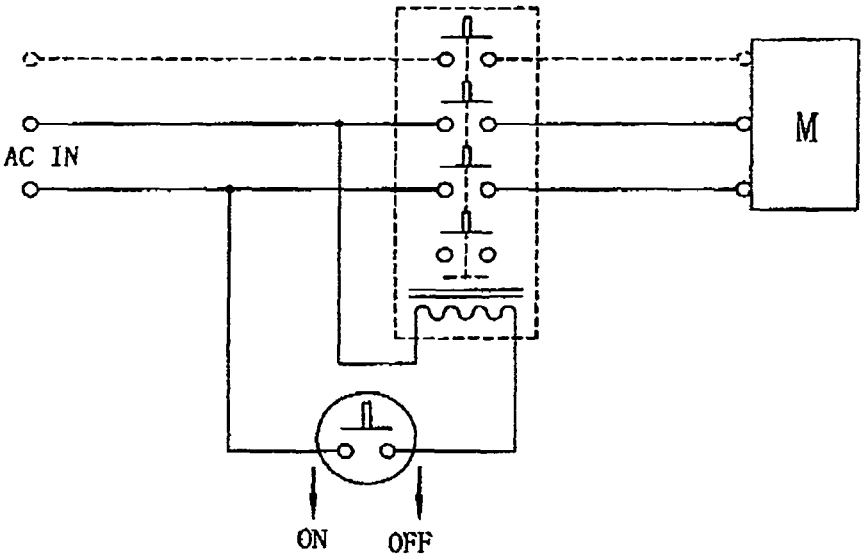
FIG. 9*a* is an operation circuit diagram of the electromagnetic switching device in accordance with the second embodiment of the present invention.
Figure 9B:
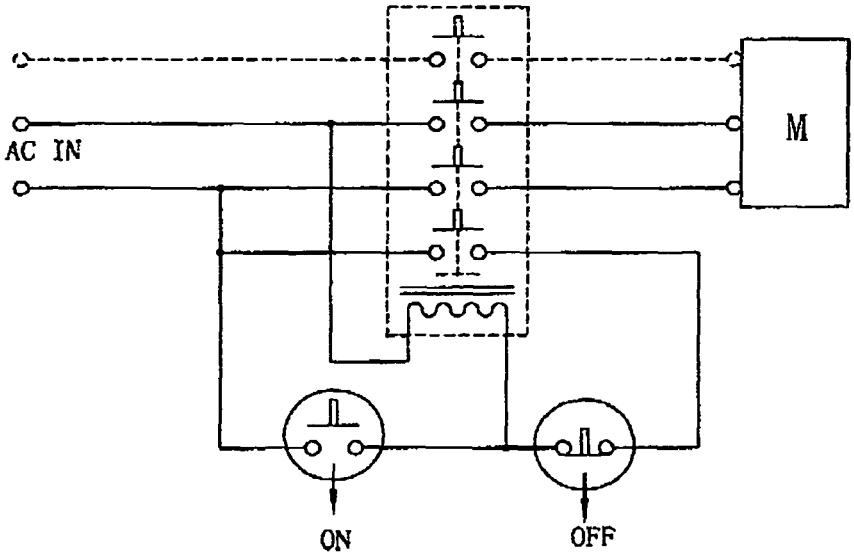
FIG. 9*b* is an operation circuit diagram of a traditional contactor.

Referring to FIGS. 9A-9B, FIG. 9A illustrates the operation circuit diagram of the electromagnetic switching device in accordance with the second embodiment of the present invention, and FIG. 9B shows the operation circuit diagram of the traditional electromagnetic switching device. The electromagnetic switching device of the present invention comprises the locking assembly, of which the circuit diagram is much simpler, and a single off-on control is desired.

The locking assembly of the present invention is used in the electromagnetic switching device. Therefore, the power energy is saved. Furthermore, only momentarily energized once, with a plurality of electronic control units and an impulse circuit, the electromagnetic switching device will be controlled to switch on and off via a remote control or network control.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. An energy-saving electromagnetic switching device comprising: a housing, and an electromagnetic assembly and a movable magnetic pole within the housing, the movable magnetic pole connected with a resilience means which engages with the movable magnetic pole to control the electromagnetic switching device switched on and off; wherein at least one locking assembly is set between the movable magnetic pole and the housing; via which the electromagnetic switching device can automatically and repeatably change from an on-state to an off-state if the electromagnetic assembly is momentarily energized; the locking assembly comprises a locking block, a locking clip and a flexible member; the locking block defines a stepwise center groove at a side face towards the locking clip; an outside face of the locking clip abuts against the flexible member, and under a prevention from the flexible member, one end of the locking clip is received in the center groove; a stopping portion projects generally at center of the groove; the center groove comprises a guiding groove section, limiting groove section, unlocking groove section, and returning groove section, which are successively associated together and surround the stopping portion; whereby, when the electromagnetic switching device is desired to switch on, the locking clip slides from the guiding groove section to the limiting groove section, once the electromagnetic switching device is de-energized, the locking clip slides to the unlocking groove section and is caught in the stopping portion under a resilience force of the resilience means; and when the electromagnetic switching device is desired to change from on-state to off-state the locking clip leaves the stopping portion and slides from the unlocking groove section to the returning groove section, once the electromagnetic switching device is de-energized, the locking clip slides from the returning groove section and to the guiding groove section under a resilience force of the resilience means.

2. The electromagnetic switching device according to claim 1, wherein a leading slope is bridged from bottom portion to tip portion of the guiding groove section in a gradually ascending way; the bottom portion of the guiding groove section has greater depth than that of bottom portion of the returning groove section; the limiting groove section has greater depth than that of tip portion of leading slope of the guiding groove section; the unlocking groove section has greater depth than that of the limiting groove section, a tip portion of the returning groove section has greater depth than that of the unlocking groove section; whereby, when the electromagnetic switching device is desired to switch on, the locking clip slides from the bottom of the guiding groove section along the leading slope to the limiting groove section, once the electromagnetic switching device is de-energized, the locking clip slides to the unlocking groove section and is caught in the stopping portion under a resilience force of the resilience means; and when the electromagnetic switching device is desired to change from on-state to off-state, the locking clip leaves the stopping portion and slides from the unlocking groove section to the tip portion of the returning groove section, once the electromagnetic switching device is de-energized, the locking clip slides from the tip portion along a bottom portion of the returning groove section and to the bottom portion of the guiding groove section under a resilience force of the resilience means.

3. The electromagnetic switching device according to claim 2, wherein the energy-saving electromagnetic switching device is an electric relay; the electromagnetic assembly of the electric relay comprises an iron core and a coil winding around the iron core; the movable magnetic pole of the electric relay comprises a metal body and a contact carrying arm, the metal body is located below the contact carrying arm, one end of the contact carrying arm is mounted on an upper surface of the metal body, and the other end of the arm carries a movable contact; a stationary contact is correspondingly set on the metal body; the resilience means is a spring, one end of the spring is connected at a bottom of the housing of the electric relay, and the other end thereof is connected to an end of the metal body corresponding to where the contact carrying arm is mounted; there are one locking assembly, the locking block of the locking assembly receives an end of the metal body, and the locking clip and the flexible member are mounted to the housing, the flexible member abuts against the locking clip.

4. The electromagnetic switching device according to claim 2, wherein the energy-saving electromagnetic switching device is a contactor; the electromagnetic assembly of the contactor comprises an E-shaped stationary iron core and a coil connected with the stationary iron core in the housing; the movable magnetic pole of the contactor comprises movable iron core and contact which is substantially connected with the movable iron core; the movable iron core corresponds to the stationary iron core, and is located right above the stationary iron core; the resilience means is a spring set around a center part of the stationary core; there are two locking assemblies, which are respectively and centrally located at either side of the housing of the contactor; the locking block of the locking assembly is fixed at side face of the movable iron core; one end of the locking clip is received in the center groove of the locking block, and the other end thereof is rotatably mounted in the housing of the contactor.

* * * * *